US006320146B1

(12) United States Patent
Mori

(10) Patent No.: US 6,320,146 B1
(45) Date of Patent: Nov. 20, 2001

(54) OPERATION APPARATUS

(75) Inventor: Yoshiki Mori, Aichi (JP)

(73) Assignee: Kabushiki Kaisha Tokai Rika Denki Seisakusho, Niwa-gun (JP)

( * ) Notice: Subject to any disclaimer, the term of this patent is extended or adjusted under 35 U.S.C. 154(b) by 0 days.

(21) Appl. No.: 09/355,244

(22) PCT Filed: Jan. 28, 1998

(86) PCT No.: PCT/JP98/00329

§ 371 Date: Oct. 25, 1999

§ 102(e) Date: Oct. 25, 1999

(87) PCT Pub. No.: WO98/33196

PCT Pub. Date: Jul. 30, 1998

(30) Foreign Application Priority Data

Jan. 28, 1997 (JP) ..... 9-013890

(51) Int. Cl.[7] ..... H01H 3/12; H01H 25/06

(52) U.S. Cl. ..... 200/329

(58) Field of Search ..... 200/32 R, 402–471, 200/293–307, 329, 345, 520–540, 318, 327

(56) References Cited

U.S. PATENT DOCUMENTS 3,582,582 * 6/1971 Pauker et al. ..... 200/38 B
4,027,122 * 5/1977 Bevacqua ..... 200/435
4,051,340 9/1977 Wolski ..... 200/329
4,602,137 * 7/1986 Kawasaki ..... 200/293 X

FOREIGN PATENT DOCUMENTS 2914280 10/1980 (DE) .
55-152804 10/1980 (JP) .
7-30431 6/1995 (JP) .

* cited by examiner

*Primary Examiner*—J. R. Scott
(74) *Attorney, Agent, or Firm*—Morgan, Lewis & Bockius LLP

(57) ABSTRACT

An operator is prevented from slipping out when it is pulled, and an operating apparatus equipped with such an operator can be realized at lower production cost. A hole is formed in the operator. A member to be operated is formed with a pawl such that when the operator is pushed down onto the member, the pawl is engaged with the hole. The operator is thereby firmly coupled with the member. Under this arrangement, if the operator is pulled, the member is also moved integrally with the operator. Moreover, the operating apparatus further includes a case comprising a hole. Thus, the pawl is further prevented from slipping out of the hole because any outward bending of the pawl caused by the pulling is restricted due to a peripheral part of the hole of the case.

5 Claims, 3 Drawing Sheets

OPERATION APPARATUS

TECHNICAL FIELD

The invention relates to an operating apparatus comprising an improved connecting structure between an operator and a member to be operated (hereinafter briefly called as "member").

TECHNICAL BACKGROUND

Conventionally, in an operating apparatus to be used to serve to control, for example, lights, wipers, washers, air conditioners and others, as shown in FIG. 4, an operator 1 and a member 2 are furnished. The member 2 is held in a case 3, and under this condition the operator 1 which is provided therein with a sleeve 4 is fitted on a shaft part 2*a* of the member 2 whose one part is projected from the case 3, so that the operator 1 is connected to the member 2.

In this state, the sleeve 4 is, as shown in FIGS. 5 and 6, is cut at both sides into cut portions 6 and is defined with a part 5 which protrudes inward thereof. When the operator 1 is fitted as mentioned onto the shaft part 2*a* of the member 2, the protruded part 5 is straightened by the shaft 2*a* from a state shown with a two-dotted line in FIG. 5 to a state shown with a solid line. Due to a restoring force from this straightened state to the protruded state, the protruded part 5 is pressed to the shaft 2*a,* and due to friction thereby the operator 1 is prevented from slipping out.

When a user of this apparatus holds the operator 1 to rotate, push or pull, the member 2 is accordingly rotated, pushed or pulled to carry out controllings as mentioned.

However, when the user pulls the operator 1, if the friction force at the protruded part 5 of the sleeve 4 effecting to the shaft 2*a* of the member 2 could not stand against the pulling force, the operator 1 would be probably slipped out. In particular, when a pulling operation is included in operating modes of the operator 1, it is pulled more frequently, so that slipping-out is more possibly.

Such a structure particularly wants a part as a sleeve having the protruded part 5 together with the cut portion 6 and invites high producing cost.

DISCLOSURE OF THE INVENTION

In view of these circumstances, the invention has been realized, and accordingly it is an object to offer an operating apparatus which can prevent the operator from slipping out when it is pulled, and can be produced at lower cost.

For accomplishing the object, an operating apparatus of the invention is furnished with an operator and a member to be operated by manipulating the operator, and is characterized by providing a part to be engaged furnished at the operator, an engaging part furnished at the member to be operated, the engaging part being engaged with the part to be engaged in a manner that it is returned under being outward bent by pushing the operator thereinto, and being connected with the member such that the member to be operated is moved integrally by an at least pulling operation of the operator, and a checking member furnished to stand outside of the engaging member when the operator is pulled so as to check the outside bending of the engaging member at this standing position.

According to the present instrument, when the operator is pulled, the checking member stands outside of the engaging part, and the engaging part is prevented from getting out of a part to be engaged in that the checking member checks the engaging part from the outside bending.

MOST PREFERRED EMBODIMENT FOR CARRYING OUT THE INVENTION

Explanation will be made to one embodiment of the invention with reference to FIGS. 1 to 3 of the attached drawings.

Figure 2:
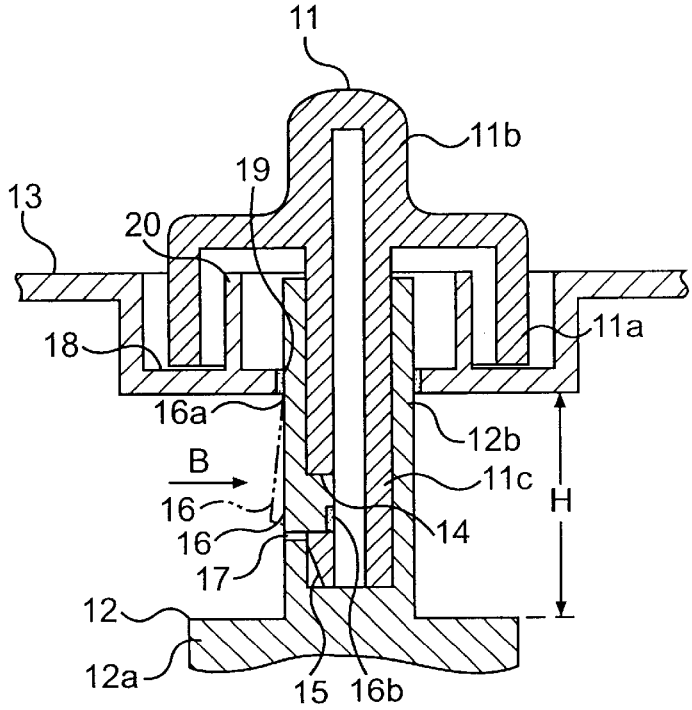
FIG. 2 is cross sectional views of the element parts in another operating state.

FIG. 2 shows the operator 11, the member 12 and a case 13. The operator 11 is made of, e.g., an ABS resin and comprises a main part 11*a* shaped in a short cylinder having a bottom, a thumb 11*b* projecting outward (upward in the drawing) from the center of an outer face of the bottom, and a shaft 11*c* projecting in opposition (downward in the drawing) to the thumb 11*b* from the center of an inner face of the bottom of the main part 11*a*. The shaft 11*c* is hollow and formed with a hole 14 as a part to be engaged in one portion of a peripheral part near a front end thereof. At the lower part than the hole 14 of the shaft 11*c,* an oblique part 15 is formed which comes near the center as going to the front end.

On the other hand, the member 12 is made of, e.g., polybutyleneterephthalete, and comprises a main part 12*a* and a shaft 12*b* extending from one end in an axial direction of the main part 12*a* to this axial direction (upward in the drawing). The shaft 12*b* of the member 12 is hollow having a larger diameter than that of the shaft 11*c* of the operator 11 and is formed with a pawl 16 as an engaging part corresponding to the hole 14 in one portion of a peripheral part of an intermediate part.

Figure 3:
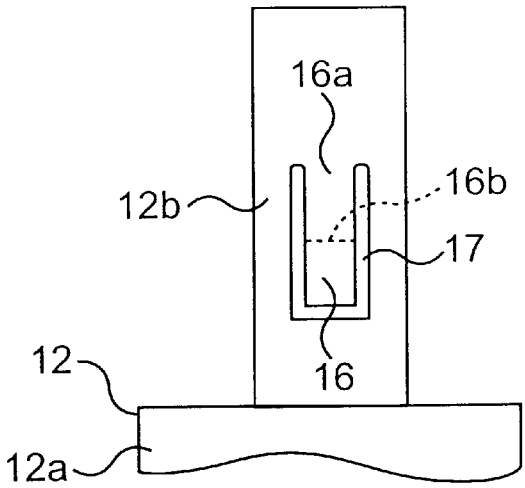
FIG. 3 is a front view of a pawl portion of the member to be operated seen from an arrow B direction of FIG. 2.
Figure 4:
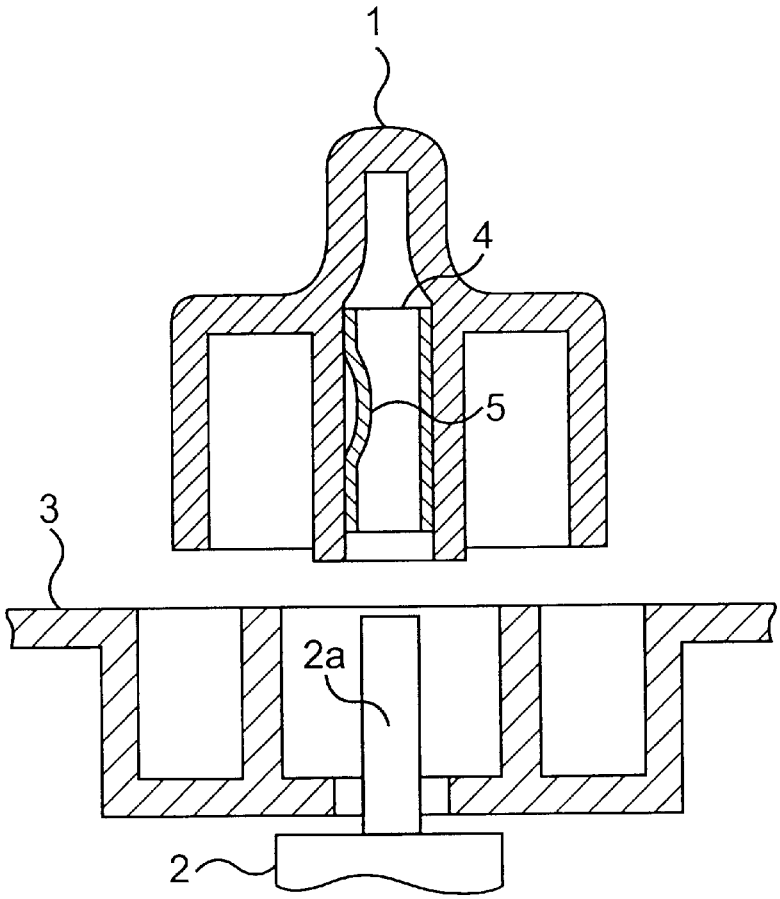
FIG. 4 is cross sectional views of element parts of a prior art.
Figure 5:
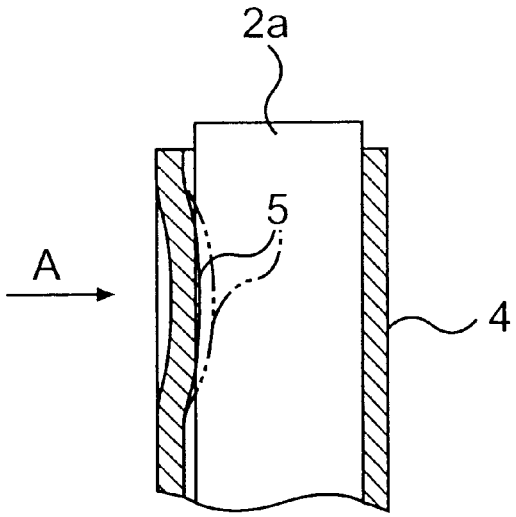
FIG. 5 is a cross sectional view showing the relation between a shaft part of the member to be operated and a sleeve part.
Figure 6:
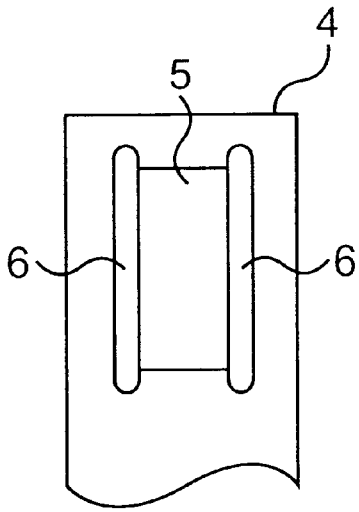
FIG. 6 is a front view of a projecting part of the sleeve seen from an arrow A direction of FIG. 5.

The pawl 16 is, as shown in FIG. 3, cut at both right and left sides and a lower side from other parts by a cut part 17, so that an only upper part 16*a* continues to other parts, and the pawl 16 is bent at the upper part 16*a* in inner and outer diametrical directions. The pawl 16 is formed with a projection 16*b* in an inside of the lower part thereof.

The case 13 is composed of, e.g., the ABS resin, and has a concave 18 of larger diameter than that of the main part 11*a* of the operator 11, and has, at the center of the concave 18, a hole 19 of larger diameter than that of the shaft 12*b* of the member 12, and further has a cylinder 20 at the periphery of the hole 19 (in the concave 18).

In the instant structure, as seen in FIG. 2, the case 13 holds therein the member 12 which projects a front end of the shaft 12*b* from the hole 19. To fit the operator 11 onto the member 12, the operator 11 is advanced from the front end of the shaft 12*b*. As the shaft 11*c* is pushed further into the shaft 12*b,* an upper part of the oblique part 15 of the shaft 11*c* comes into contact with the projection 16*b* of the pawl 16 and thereby pushes the pawl 16 bending outward, as shown with the two-dotted-line.

As the shaft 11*c* is pushed even further into the shaft 12*b,* the hole 14 meets the pawl 16 and eventually comes to a position agreeing to the projection 16*b* of the pawl 16. The pawl 16 is thereby released from the outward pushing (bending), and is returned inward so as to insert the projection 16*b* into the hole 14. The operator 11 is thus engaged with the member 12.

Figure 1:
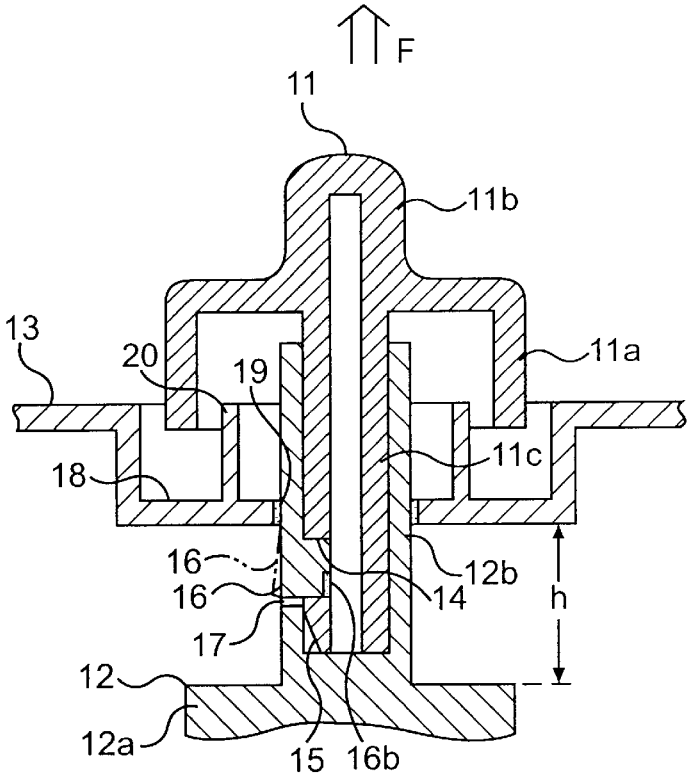
FIG. 1 is cross sectional views of element parts showing one embodiment of the invention.

Under this engagement, if an upward force F pulls the operator 11, the member 12 is also moved integrally with the operator 11 to a position shown in FIG. 1 (an up-position). Thus, the vertical distance between the member 12 and the case 13 decreases from H to h. This movement is primarily due to the engaging structure between the hole 14 and the projection 16*b* of the pawl 16.

In the up-position, the pawl 16 of the shaft 12*b* is in a row with and near the inside of the hole 19 of the case 13, and in other words, the peripheral part of the hole 19 stands in line with and near the outside of the pawl 16 of the shaft 12*b*. Therefore, the outward bending of the pawl 16, that is, a displacement for causing the projection 16*b* to escape from the hole 14 of the shaft 12*b* of the operation 11, is checked by the peripheral part of the hole 19 of the case 13, so that the pawl 16 is thereby prevented from getting out from the hole 14, and by maintaining the engagement, the operator 11 is avoided from slipping out.

Thus, in the present structure, even if the operator 11 is pulled, it is never slipped out as the existing operator 1 is done, and besides the structure therefor is only that the operator 11 is formed with the hole 14 and the member 12 is formed with the pawl 16, and by such a structure only, the inventive apparatus can be realized at lower cost without especially requiring a member such as the sleeve 4 as the prior art.

In particular, in the present structure, what checks the outward bending of the pawl 16 when the operator 11 is pulled, is the case 13, namely, the case 13 serves as a checking member of the bending, and not necessitating any special member to be used exclusively for checking, so that the apparatus is provided economically.

If the operator 11 is pushed from the instant pulling condition, the member 12 is pushed by the front end of the shaft 11*c* of the operator 11 and returned to the position shown in FIG. 2 (the down position). At this position, the pawl 16 of the shaft 12*b* separates from the hole 19 of the case 13 and is released from the checking, so that the pawl 16 can be freely bent outward, and the connection of the operator 11 is made at this position. The positions of pushing and pulling operations are kept by a moderation mechanism (not shown).

In each position of pushing and pulling operations, when the operator 11 is rotated, the shaft 12*b* of the member 12 and, finally, a whole body of the member 12 is pulled integrally through the engaging structure between the pawl 14 and the projection 16*b* of the pawl 16.

In a case of the present embodied example, the rotating operation of the member 12 by the operator 11 is divided into three steps. At the first step, for example, a small lamp of an automobile is lighted, in addition at the second step, a head lamp is turned on, at the three step, in addition thereto, a rear fog lamp is lighted, and at the inside of the case 13, a point of contact mechanism therefor is arranged. A position for rotating operation is kept by the moderation mechanism (not shown).

A front fog lamp is lighted by pulling the member 12 by the operator 11, and at the inside of the case 13, a connection mechanism therefor is arranged.

Note that the invention is not limited only to the above mentioned and shown embodiments, and in particular the concrete content of the operation is not limited to the light control of the automobile, but applied to wipers, washers, air conditioners and other controls, and to control of other than automobiles. The controls may depend upon the pushing operation only of the operator 11 or the rotating operation.

Further, it is allowed that the part to be engaged of the operator 11 may be a convex, not the hole 14, and the engaging part of the member to be operated may have a concave, not the pawl 16 with the projection 16*b*.

The invention is as explained above and has the following effects.

According to an operating apparatus of claim 1, when the operator is pulled, the checking member positions outside of the part engaging the part to be engaged of the operator so as to check the outward bending of the engaging part for preventing the engaging part from getting out from the part to be engaged, whereby it is possible to securely avoid the slipping-out of the operator when pulling the operator, and this measuring can be provided without requiring any special members and the present apparatus can be provided at low cost.

According to an operating apparatus of claim 2, the case holding therein the member to be operated can be utilized as the checking member and this measuring can be provided without requiring any special members, and the present apparatus can be provided at low cost.

What is claimed is:

1. An operating apparatus comprising:

an operator;

a member; and a checking member;

wherein the operator comprises a part to be engaged with the member;

the member comprises an engaging part having a first position of straight and a second position of an outward bend such that as the operator being pushed into the member, the engaging part is returned from the second position and engaged with the part to be engaged;

when the engaging part is engaged with the part to be engaged, the member is thereby engaged with the operator and the member moves integrally with the operator; and when the member is engaged with the operator and an at least pulling operation is asserted onto the operator, the engaging part moves into contact with the checking member and the checking member maintains the integration of the operator and the member.

2. The apparatus as set forth in claim 1, characterized in that the checking member is a case holding therein the member.

3. The apparatus as set forth in claim 1, wherein when the engaging part moves into contact with the checking member, the engaging part is restricted from being at the second position.

4. The apparatus as set forth in claim 1, wherein the engaging part is a pawl having a projection and the part to be engaged is an opening such that when the operator and the member are engaged, the projection is fitted into the opening.

5. The apparatus as set forth in claim 1, wherein the operator further comprises an oblique part such that when the oblique part is in contact with the engaging part, the engaging part is forced to be in the second position.

* * * * *